US012662820B1

(12) United States Patent
Smith

(10) Patent No.: US 12,662,820 B1
(45) Date of Patent: Jun. 23, 2026

(54) DOWNSPOUT DIVERTER AND EXTENSION

(71) Applicant: Spectra Metal Sales, Inc., Atlanta, GA (US)

(72) Inventor: Jeffrey Eugene Smith, Atlanta, GA (US)

(73) Assignee: Spectra Metal Sales Inc., Atlanta, GA (US)

( * ) Notice: Subject to any disclaimer, the term of this patent is extended or adjusted under 35 U.S.C. 154(b) by 0 days.

(21) Appl. No.: 18/419,922

(22) Filed: Jan. 23, 2024

Related U.S. Application Data

(60) Provisional application No. 63/486,092, filed on Feb. 21, 2023.

(51) Int. Cl.
*E04D 13/08* (2006.01)

(52) U.S. Cl.
CPC ..... *E04D 13/08* (2013.01); *E04D 2013/0813* (2013.01); *E04D 2013/082* (2013.01)

(58) Field of Classification Search
CPC ..... E04D 13/08; E04D 2013/0813; E04D 2013/082
See application file for complete search history.

(56) References Cited

U.S. PATENT DOCUMENTS 2,966,171 A * 12/1960 Kotlar ..... E04D 13/08 134/901
3,904,121 A * 9/1975 Geagan ..... E04D 13/08 239/282
4,135,540 A * 1/1979 Felsen ..... E04D 13/08 137/875
8,075,765 B2 * 12/2011 Perlatti ..... B29C 66/1122 210/170.03
8,689,837 B1 * 4/2014 Smith ..... F16L 11/121 285/179
9,091,071 B2 * 7/2015 Crawford ..... E04D 13/08
9,243,386 B2 * 1/2016 Perlatti ..... E03B 3/02
11,274,448 B1 * 3/2022 Horstmyer ..... E04D 13/08
2011/0226350 A1 * 9/2011 Russell ..... E04D 13/08 137/561 A
2018/0274240 A1 * 9/2018 Kilbert ..... F16L 25/0009
2021/0340770 A1 * 11/2021 Buhler ..... E04D 13/08

FOREIGN PATENT DOCUMENTS

KR 101379204 B1 * 4/2014 ..... E04D 13/0767

OTHER PUBLICATIONS

Translation KR 101379204.*

* cited by examiner

*Primary Examiner* — Kevin F Murphy
(74) *Attorney, Agent, or Firm* — Eversheds Sutherland (US) LLP

(57) ABSTRACT

A device is provided for use with a rain downspout to output water. The device may include an input port configured to receive the water. The device also may include a first output port and a second output port. The first output port may be configured to output a first portion of the received water in a first direction, and the second output port may be configured to output a second portion of the received water in a second direction.

18 Claims, 8 Drawing Sheets

DOWNSPOUT DIVERTER AND EXTENSION

CROSS-REFERENCE TO RELATED APPLICATIONS

This application claims priority to and the benefit of U.S. Provisional Application No. 63/486,092, filed Feb. 21, 2023, which is hereby incorporated by reference herein in its entirety.

FIELD

This disclosure relates generally to rain downspouts and more particularly to rain downspouts with one or more diverters and/or extensions.

BACKGROUND

Rain downspouts for buildings provide a mechanism for water collected in rain gutters to output to the ground. It is particularly useful to discharge such water in a manner that it moves away from the foundation of the building to prevent erosion of the foundation.

To ensure that the water from a downspout is outlet at a distance sufficiently far from the foundation, many times a downspout extension is connected to the output of the downspout. Even with an extension, water from the downspout may still result in erosion, if not at the foundation of the building, then at the area of the land surrounding the building. Such erosions may damage grass, create gullies, or generally decrease the look of the land.

BRIEF DESCRIPTION OF THE DRAWINGS

The detailed description is set forth with reference to the accompanying drawings. In some instances, the use of the same reference numerals may indicate similar or identical items. Various embodiments may utilize elements and/or components other than those illustrated in the drawings, and some elements and/or components may not be present in various embodiments. Throughout this disclosure, depending on the context, singular and plural terminology may be used interchangeably.

DETAILED DESCRIPTION

This disclosure relates generally to a downspout extension that includes a multiple outlet diverter to distribute the water from the downspout to different areas, thus decreasing erosion or other issues that may arise to any one area. In accordance with one or more embodiments of the present disclosure, the downspout extension attaches to a downspout to direct rainwater away from a building in multiple directions. In some instances, the extension includes a removable downspout connector that allows connection to differently sized and shaped downspouts. The removable connector may include flexible expandable bellows that allow for proper connection to the existing downspout. The extension may transition into a plurality of smaller outlets. Threaded tubes with adjustable portions may screw onto the transition outlets and direct water to the desired locations.

The downspout extension may move water away from a foundation of a building to help to prevent water damage to the structure. In some instances, the downspout extension and diverter in accordance with one or more embodiments of this disclosure may be configured to direct the water to locations that need additional water like scrubs and trees. Disbursing the flow of water into multiple channels also may also reduce erosion.

Figure 1:
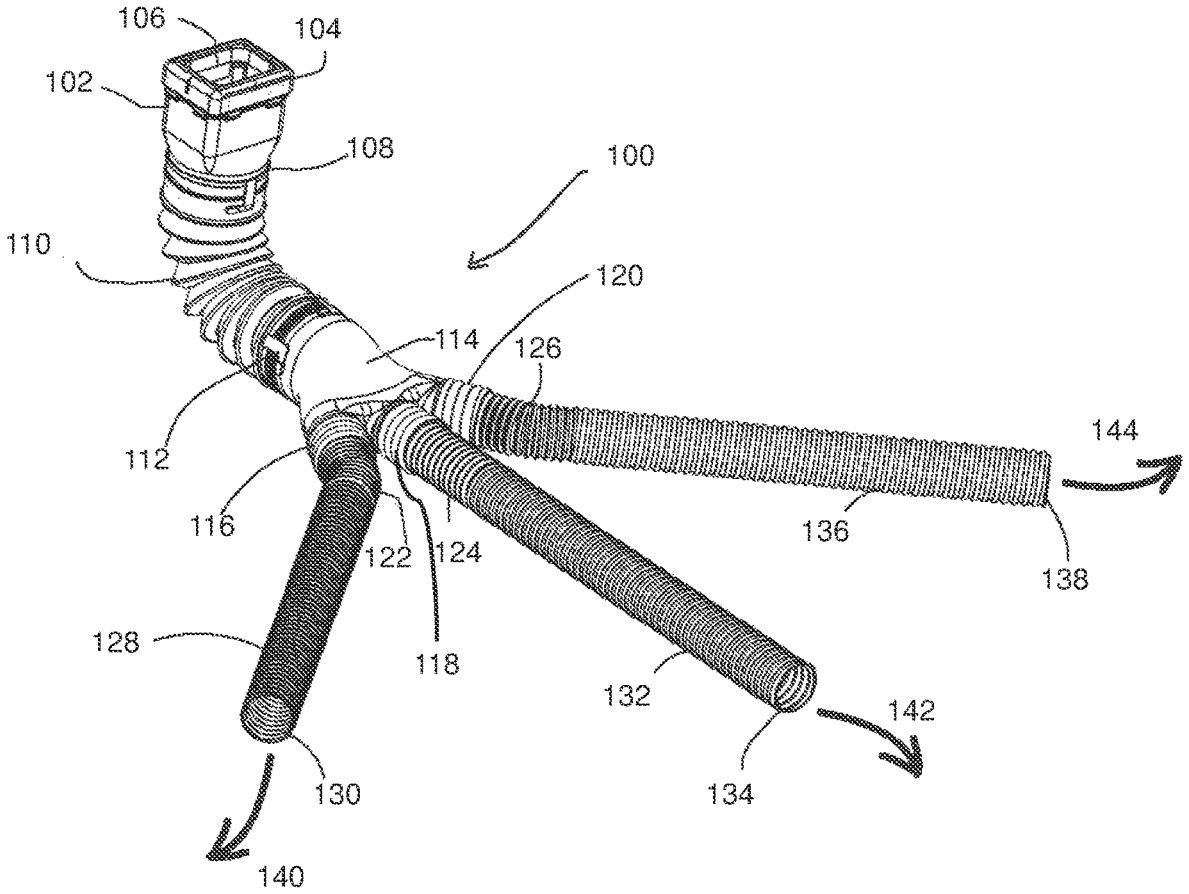
FIG. 1 illustrates a perspective view of an example multi-directional downspout diverter (MDD) in accordance with one or more embodiments of the present disclosure.

Turning now to the drawings, FIG. 1 illustrates a perspective view of a multi-directional downspout diverter (MDD) 100 in accordance with one or more embodiments of the present disclosure. In some instances, the MDD 100 includes a downspout connector 102, a downspout connector 104, an inlet end 106, a downspout connector 108, a flexible bellows 110, a twist lock female tab 112, a multi-outlet transition (MOT) 114, a threaded screw-on connector 116, a threaded screw-on connector 118, a threaded screw-on connector 120, a flexible bellows 122, a flexible bellows 124, a flexible bellows 126, a corrugated spiral pipe 128 having an output port 130, a corrugated spiral pipe 132 having an output port 134, and/or a corrugated spiral pipe 136 having an output port 138.

In one or more embodiments, the downspout connector 102 has about a 3 inch by about 4 inch rectangular opening configured to receive a conventional 3 inch by 4 inch rectangular downspout. The downspout connector 104 may be configured to be detachably fastened to the downspout connector 102. In one or more embodiments, the downspout connector 104 has about a 2 inch by about 3 inch rectangular opening configured to receive a conventional 2 inch by 3 inch rectangular downspout. The downspout connector 104 may be configured to be detachably fastened to the downspout connector 102. The downspout connector 104 may be any suitable size, shape, or configuration.

In one or more embodiments, the downspout connector 108 has about a 4 inch diameter circular opening configured to receive a conventional 4 inch diameter circular downspout. In one or more embodiments, the downspout connector 108 is an input portion of the flexible bellows 110.

If the downspout for which MDD 100 is being used will not fit into the downspout connector 102 or the downspout connector 104, but will fit into the downspout connector 108, then the downspout connector 102 and the downspout connector 104 may be detached from the downspout connector 108. As such, the downspout may be positioned so as to let the rainwater enter into the downspout connector 108. Further, if the downspout for which MDD 100 is being used will not fit into the downspout connector 104, but will fit into the downspout connector 102, then the downspout connector 104 may be detached from the downspout connector 102. As such, the downspout may be positioned so as to let the rainwater enter into the downspout connector 102. Finally, if the downspout for which MDD 100 is being used will fit into the downspout connector 104, then the downspout connector 104 may remain on the downspout connector 102. As such, the downspout may be positioned so as to let the rainwater enter into the downspout connector 104.

In one or more embodiments, the multi-outlet transition (MOT) 114 has three output ports configured to provide an outflow of water to the flexible bellows 122, 124, and 126, respectively. It should be noted that a MOT in accordance with other embodiments may include a positive integer number N of output ports, whereas the three output ports of MOT 114 are provided for purposes of discussion. That is, any suitable number of output ports may be used herein.

In some embodiments, the threaded screw-on connector 116 may be configured to screw onto the MOT 114 and to screw onto the flexible bellows 122 so as to detachably fasten the flexible bellows 122 to the MOT 114. In other embodiments, the threaded screw-on connector 116 may be configured to screw onto the MOT 114 but be integral with the flexible bellows 122.

Similarly, in some embodiments, the threaded screw-on connector 118 may be configured to screw onto the MOT 114 and to screw onto the flexible bellows 124 so as to detachably fasten the flexible bellows 124 to the MOT 114. In other embodiments, the threaded screw-on connector 118 may be configured to screw onto the MOT 114 but be integral with the flexible bellows 124.

Similarly, in some embodiments, the threaded screw-on connector 120 may be configured to screw onto the MOT 114 and to screw onto the flexible bellows 126 so as to detachably fasten the flexible bellows 126 to the MOT 114. In other embodiments, the threaded screw-on connector 120 may be configured to screw onto the MOT 114 but be integral with the flexible bellows 126.

The screw-on connectors 116, 118 and 120 may be configured to provide a water tight fit between the MOT 114 and the respective flexible bellows 122, 124, and 126.

In one or more embodiments, the flexible bellows 122 may be configured to be adjusted such that water exiting the flexible bellows 122 may be in a different direction relative to the water entering the flexible bellows 122. Similarly, the flexible bellows 124 and 126 may be additionally configured to be adjusted such that the direction water exits the flexible bellows 124 and 126, respectively, may be different from the direction of the water entering the flexible bellows 124 and 126, respectively.

In one or more embodiments, the corrugated spiral pipe 128 may include an output port 130 to output an outflow 140, which is a portion of the water entering the MOT 114. Similarly, the corrugated spiral pipe 132 may include an output port 134 to output an outflow 142, which is a portion of the water entering the MOT 114. Further, the corrugated spiral pipe 136 may include an output port 138 to output an outflow 144, which is a portion of the water entering the MOT 114.

Figure 2:
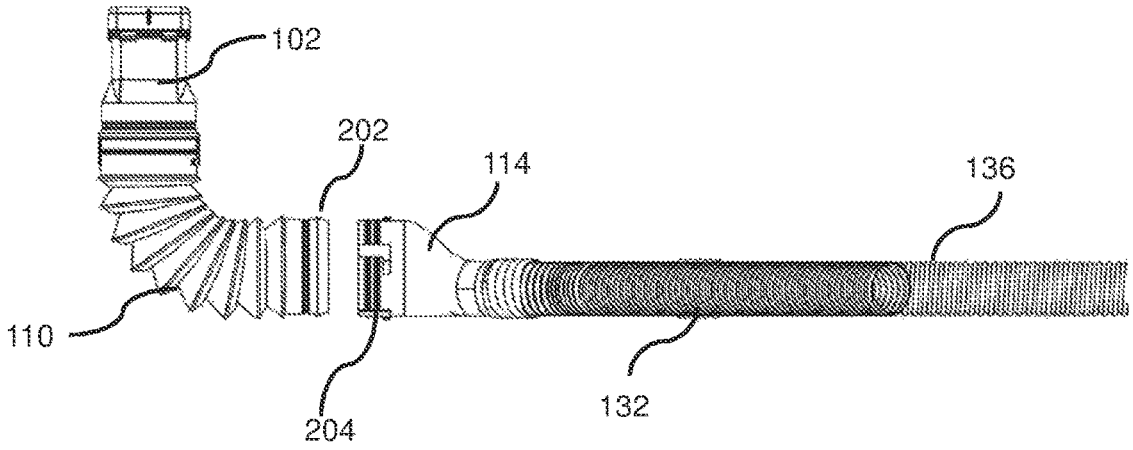
FIG. 2 illustrates a side view of the MDD of FIG. 1 with a three outlet transition separated from a flexible bellows in accordance with one or more embodiments of the present disclosure.
Figure 3:
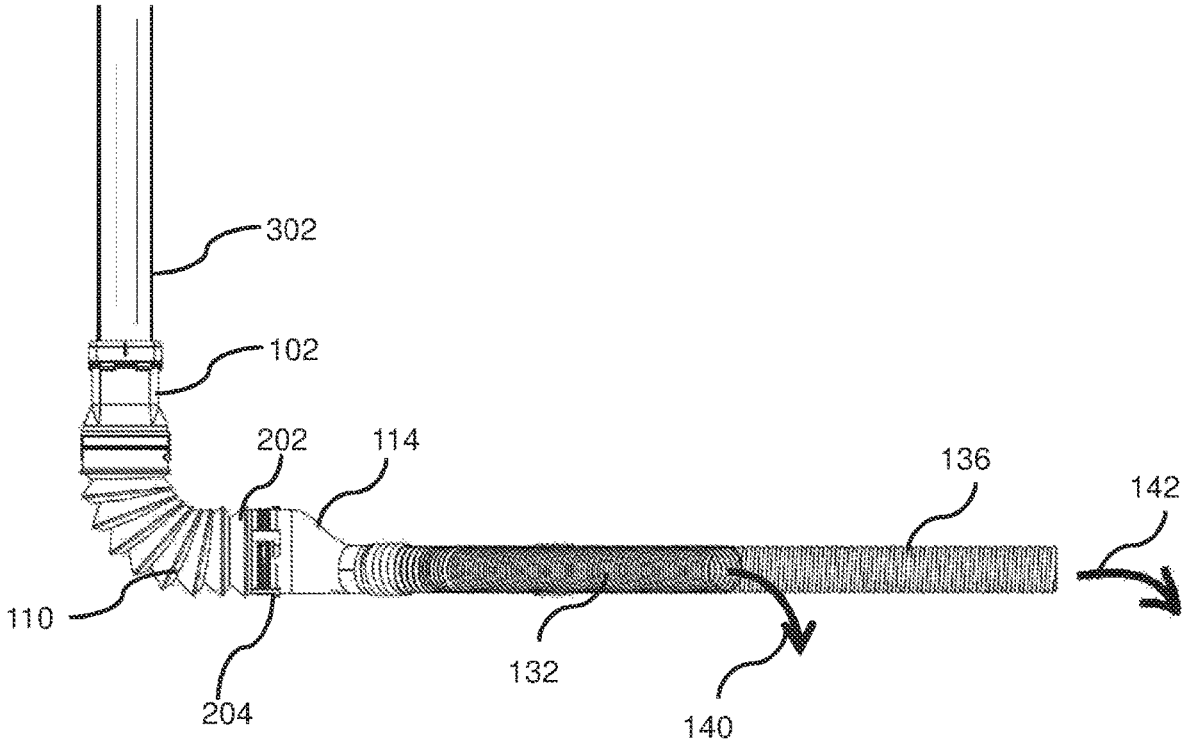
FIG. 3 illustrates a side view of the MDD of FIG. 1 as connected to a downspout in accordance with one or more embodiments of the present disclosure.

FIG. 2 illustrates a side view of the MDD 100, with the MOT 114 separated from the flexible bellows 110. The flexible bellows 110 has an open end 202 that is configured to connect with an input port 204 of the MOT 114. FIG. 3 illustrates a side view of the MDD 100, as connected to a downspout 302.

Figure 4:
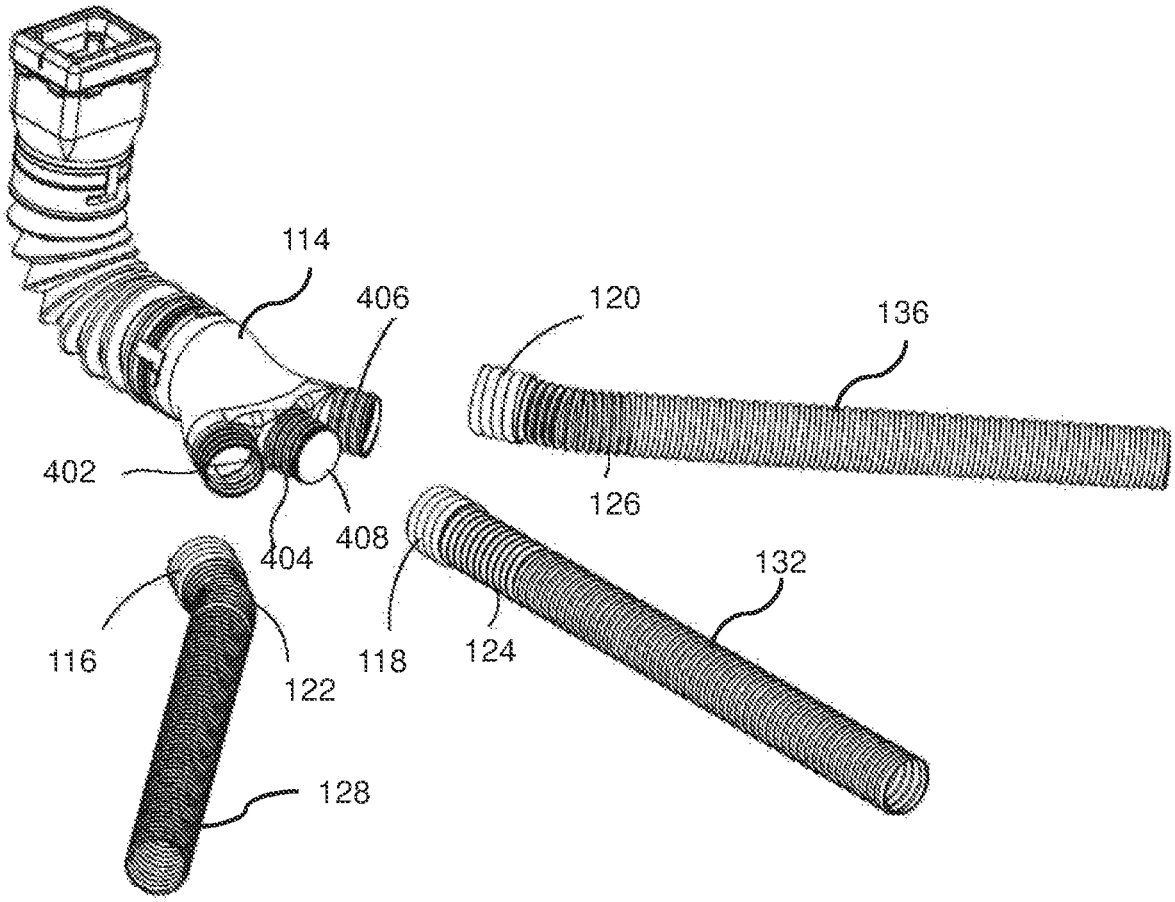
FIG. 4 illustrates a partially exploded perspective view of the MDD of FIG. 1 with three corrugated spiral outflow pipes being disconnected in accordance with one or more embodiments of the present disclosure.

FIG. 4 illustrates a perspective view of the MDD 100, with three corrugated spiral outflow pipes, being disconnected. The MOT 114 may include an output port 402, an output port 404, and an output port 406. The MOT 114 may include fewer or more output ports. In one or more embodiments, at least one output port of the MOT 114 may include a cap that is configured to cover the at least one output port so as to close the at least one output port. The cap may be configured to be removed so as to open the at least one output port. For example, in the embodiment illustrated in FIG. 4, the output port 404 has a cap 408 disposed thereon. The cap 408 may be disposed on any of the output ports. That is, any number of caps may be used herein. In some instances, the caps may be initially formed on the output ports and thereafter removed. In other instances, the caps may be removeably detached to the output ports before, during, or after manufacturing.

With the cap 408 on the output port 404, water that is input into the MOT 114 may be output by the output port 402 and the output port 406, but not the output port 404. In this state, the MOT 114 will divert the rain water into two separate destinations, one as directed by the corrugated spiral pipe 128 and one as directed by the corrugated spiral pipe 136. In this manner, any localized erosion from water outflowing from either the corrugated spiral pipe 128 or the corrugated spiral pipe 136 will be decreased, as each will only receive a portion of the rain water that is input into the MOT 114.

The cap 408 may be any known type of cap, non-limiting examples of which include a screw on cap and a cut-away cap. For example, if the cap 408 is an integral portion of the output port 404, then the cap 408 may be cut away from the output port 404. If the cap 408 is a screw on cap, then the cap 408 may include a circumferential thread, and the output port 404 may include a second circumferential thread corresponding to the circumferential thread on the cap 408. In such a case, the cap 408 may be detached from (or conversely detachably fastened to) the output port, wherein the circumferential thread of the cap 408 may be turned such that the circumferential thread on the cap 408 engages with the circumferential thread on the output port 404. Any suitable attachment mechanism may be used herein.

By providing one or more output ports with a respective detachable cap, a user may configure the MOT 114 to divert different portions of the received water to different areas, as needed. This will provide the user with more control over localized erosion by the outflow of water from the MOT 114.

Figure 5A:
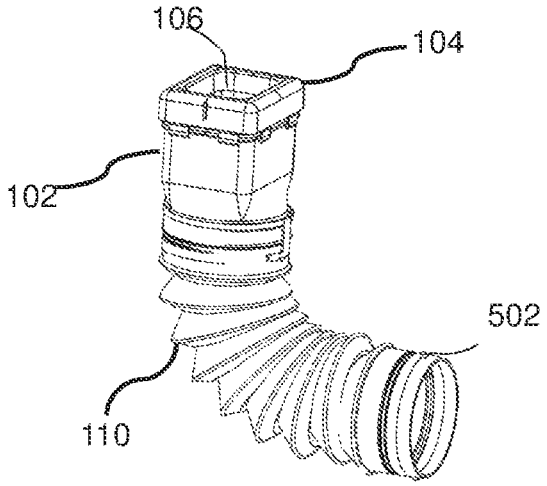
FIG. 5A illustrates a perspective view of an input port and a flexible bellows of the MDD of FIG. 1 in accordance with one or more embodiments of the present disclosure.

FIG. 5A illustrates a perspective view of the downspout connectors 102 and 104 and the flexible bellows 110. In certain embodiments, the flexible bellows 110 may include an output port 502 to mate with and inlet 604 of the MOT 114.

Figure 5B:
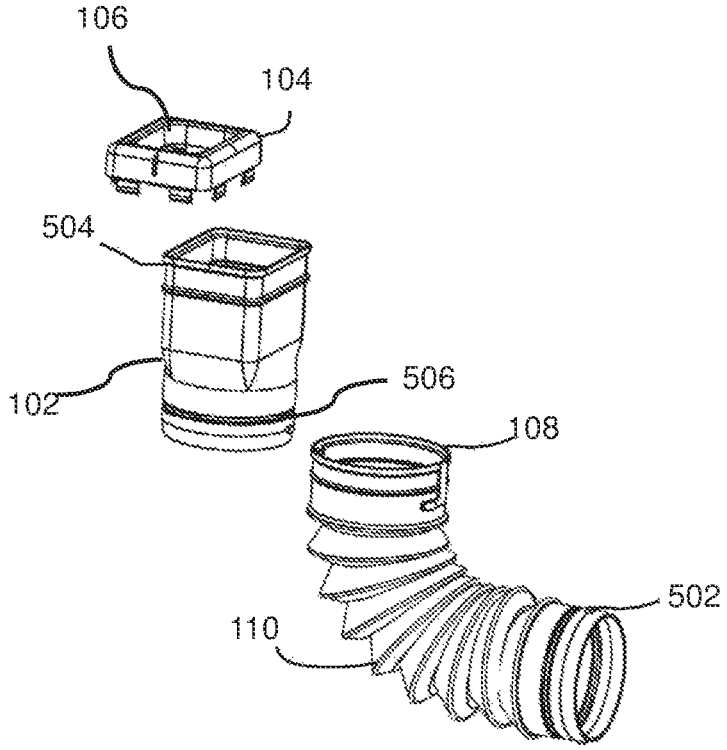
FIG. 5B illustrates an exploded view of the input port and the flexible bellows of FIG. 5A in accordance with one or more embodiments of the present disclosure.

FIG. 5B illustrates an exploded view of the downspout connectors 102 and 104 and the flexible bellows 110. The downspout connector 104 may be configured to detachably fasten to an input port 504 of the downspout connector 102. The input port 504 of the downspout connector 102 may include a rectangular shape to match the rectangular shape of the downspout connector 104. However, an output port 506 of the downspout connector 102 may include a circular shape to match the circular shape of the downspout connector 108.

Figure 6A:
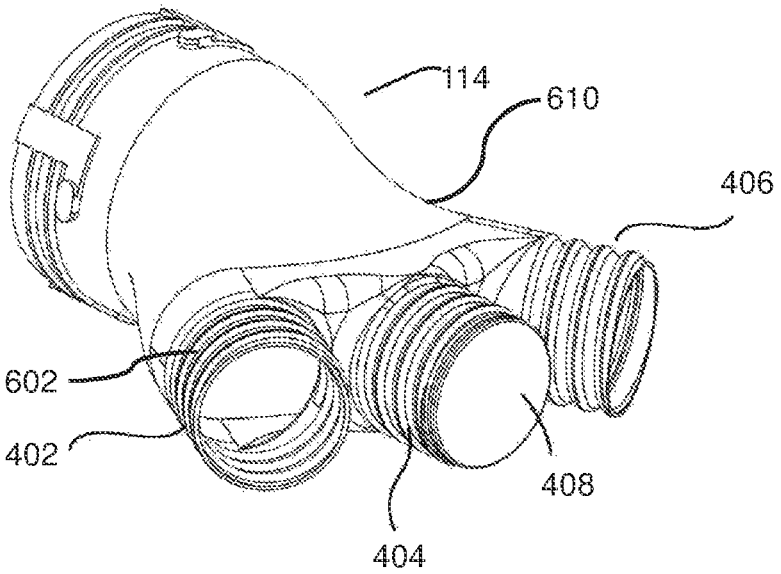
FIG. 6A illustrates a perspective view of the three outlet transition of the MDD of FIG. 1 in accordance with one or more embodiments of the present disclosure.

FIG. 6A illustrates a perspective view of the MOT 114. Each of the output ports 402, 404, and 406 may include a respective circumferential thread, a sample of which is labeled as thread 602. These threads may be configured to engage with a respective threaded screw-on connector, as will be described in greater detail below.

Figure 6B:
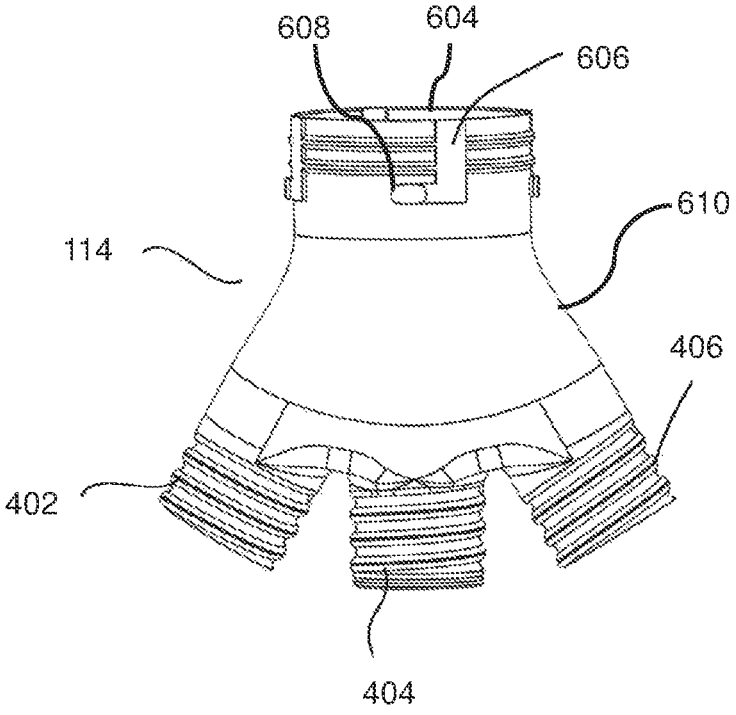
FIG. 6B illustrates a top view of the three outlet transition of FIG. 6A in accordance with one or more embodiments of the present disclosure.

FIG. 6B illustrates a top view of the MOT 114. The MOT 114 may include in input port 604 (i.e., an inlet) configured to receive water from the flexible bellows 110. The input port 604 may include a plurality of circumferentially disposed twist-lock male tabs, a sample of which is labeled as twist-lock male tab 606. Each twist-lock make tab may include a respective protrusion, a sample of which is labeled as protrusion 608 on the twist-lock male tab 606. Any suitable attachment mechanical may be used herein.

The MOT 114 may include a transition section 610. The transition section 610 may be configured to provide a fluid path from the input port 604 to the output ports 402, 404, and 406. In this manner, in some instances, the input port 604 may include a larger opening than each of the output ports 402, 404, and 406. In some instances, the output ports 402, 404, and 406 may be disposed in the same plane but directed in different directions. For example, the output port 404 may be generally in line with the input port 604, while the output ports 402 and 406 may be at least slightly angled to their respective sides. In some instances, the input port 604 may be substantially normal to one or more of the output ports 402, 404, and 406. In other instances, the input port 604 may be substantially in line with one or more of the output ports 402, 404, and 406. The input port 604 and the output ports 402, 404, and 406 may be at any suitable angle relative to one another. In some instances, the input port 604 may be coupled directly to the downspout. In other instances, one or more intermediate pieces may couple the input port 604 to the downspout.

In operation, when the output port 502 of the flexible bellows 110 is mated with the input port 604 of the MOT 114, the flexible bellows 110 may be rotated such that female locking members will engage with the respective protrusions on the twist-lock make tabs on the input port 604, thus locking the flexible bellows 110 to the MOT 114. However, in this state, the MOT 114 may be detachably fastened to the flexible bellows 110. In particular, in one or more embodiments, the twist-lock male tabs may be configured to be depressed so as to separate from their respective female counterparts. When all the twist-lock male tabs are simultaneously depressed and thus separated from their respective female counterparts, the flexible bellows 110 may be rotated in an opposite direction so as to disengage all the twist-lock male tabs from the female locking members. This will permit the flexible bellows 110 to be detached from the MOT 114.

Figure 7A:
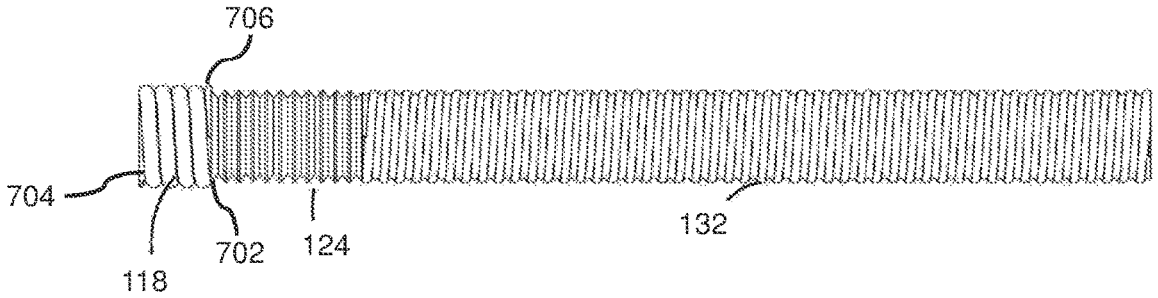
FIG. 7A illustrates a side view of a corrugated spiral outflow pipe of the MDD of FIG. 1 in accordance with one or more embodiments of the present disclosure.

FIG. 7A illustrates a side view of a corrugated spiral outflow pipe of the MDD 100. Threaded screw-on connector 118 may include an end 702 and an end 704. The end 702 may be configured to screw onto flexible bellows 124, whereas the end 704 may be configured to screw onto the output port 404 of the MOT 114. In this manner, the flexible bellows 124 may be detachably fastened to the output port 404 of the MOT 114. Further, the screw connection of the threaded screw-on connector 118 may provide a relatively water tight fit between the output port 404 of the MOT 114 and the threaded screw-on connector 118 and between the threaded screw-on connector 118 and the flexible bellows. It should be noted that the threaded screw-on connectors 120 and 116 have a similar form and function to that of the threaded screw-on connector 118, but will not be further discussed for purposes of brevity. Any suitable attachment mechanism may be used herein.

Figure 7B:
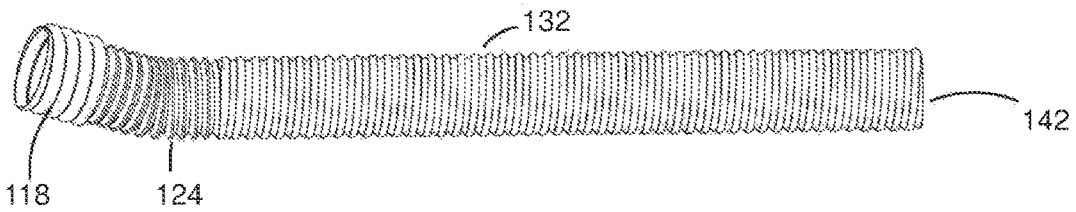
FIG. 7B illustrates a side view of the corrugated spiral outflow pipe of FIG. 7A with a flexible bellows being bent in accordance with one or more embodiments of the present disclosure.

FIG. 7B illustrates a side view of the corrugated spiral outflow pipe of FIG. 7A, with a flexible bellows being bent. In FIG. 7A, the direction of flow into end 704 may be the same as the direction of flow out of corrugated spiral pipe 132. However, as shown in FIG. 7B, flexible bellows 124 have been bent so as to change the relative direction of flow out of corrugated spiral pipe 132. For example, as shown in FIG. 1, the flexible bellows 124 are not bent, such that water enters the flexible bellows 124 in a direction that is the same direction as the outflow 142 from the outlet end 134 of corrugated spiral pipe 136. However, the flexible bellows 122 are bent, such that water enters the flexible bellows 122 in a direction that is not same direction as the outflow 144 from the outlet end 130 of corrugated spiral pipe 128. Similarly, the flexible bellows 126 are bent, such that water enters the flexible bellows 126 in a direction that is not same direction as the outflow 144 from the outlet end 138 of corrugated spiral pipe 136. In this manner, more generally, each of the flexible bellows 122, 124, and 126 may be bent to direct a portion of water to a desired area.

Figure 8:
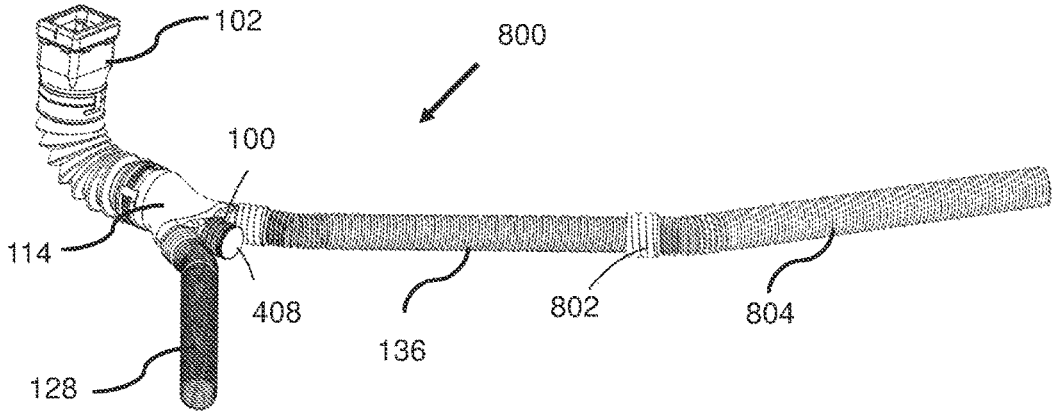
FIG. 8 illustrates a perspective view of a MDD with an additional corrugated spiral outflow pipe extender in accordance with one or more embodiments of the present disclosure.

FIG. 8 illustrates a perspective view of a MDD 800. The MDD 800 is similar to the MDD 100 as discussed above with reference to FIGS. 1-7B. However, in the MDD 800, cap 408 is on the MOT 114 and an additional extension has been added to corrugated spiral pipe 136. In particular, a threaded screw-on connecter 802 is screwed onto the outlet end 138 of the corrugated spiral pipe 136. Further, another length of corrugated spiral pipe 804 is screwed onto the threaded screw-on connector 802, thus detachably fastening the corrugated spiral pipe 804 to corrugated spiral pipe 136. In a similar manner, any number of additional corrugated spiral pipes may be added to increase the distance of displacement of the outflow of water from the location of the MOT 114.

Figure 9:
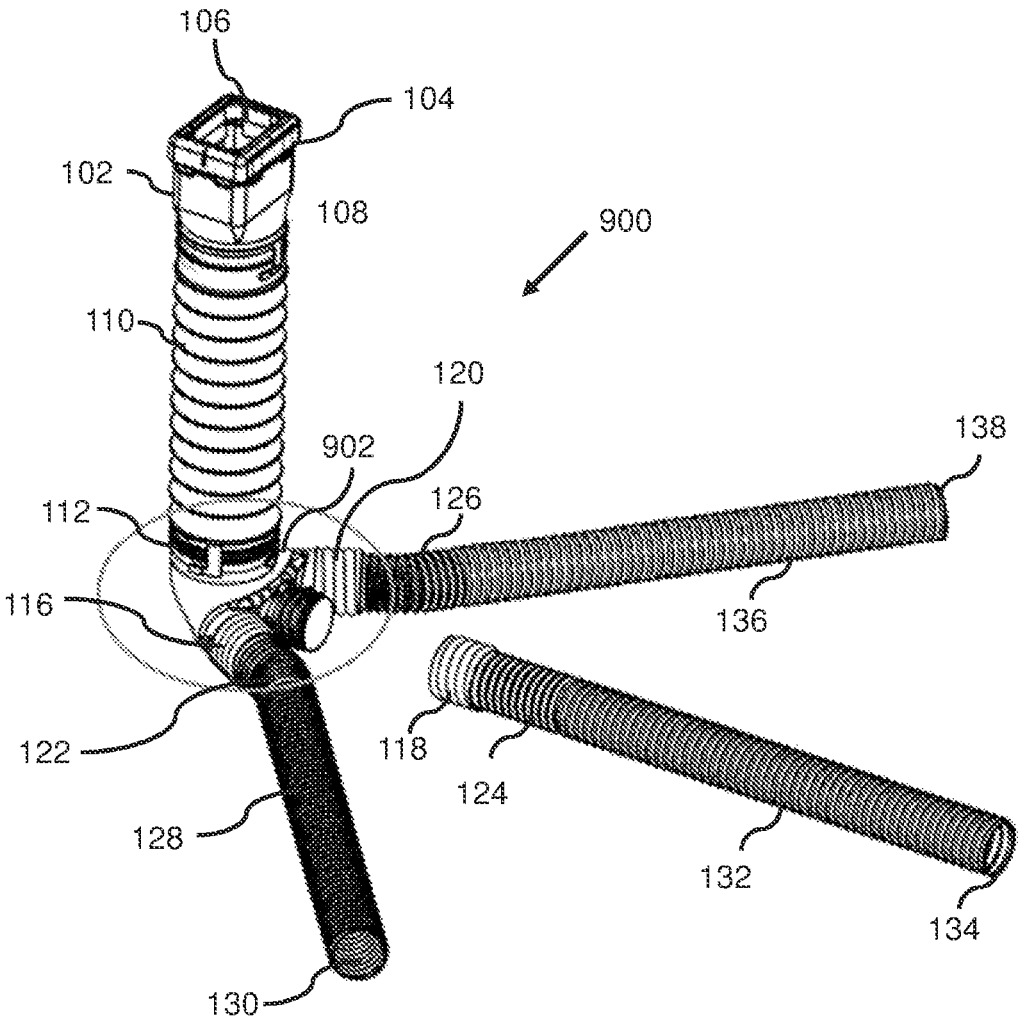
FIG. 9 illustrates a perspective view of another example MDD in accordance with one or more embodiments of the present disclosure.

FIG. 9 illustrates a perspective view of another example MDD 900 in accordance with one or more embodiments of the present disclosure.

MDD 900 differs from MDD 100 discussed above with reference to FIG. 1 in that the MOT 114 of MDD 100 is replaced with an MOT 902 in the MDD 900.

Figure 10:
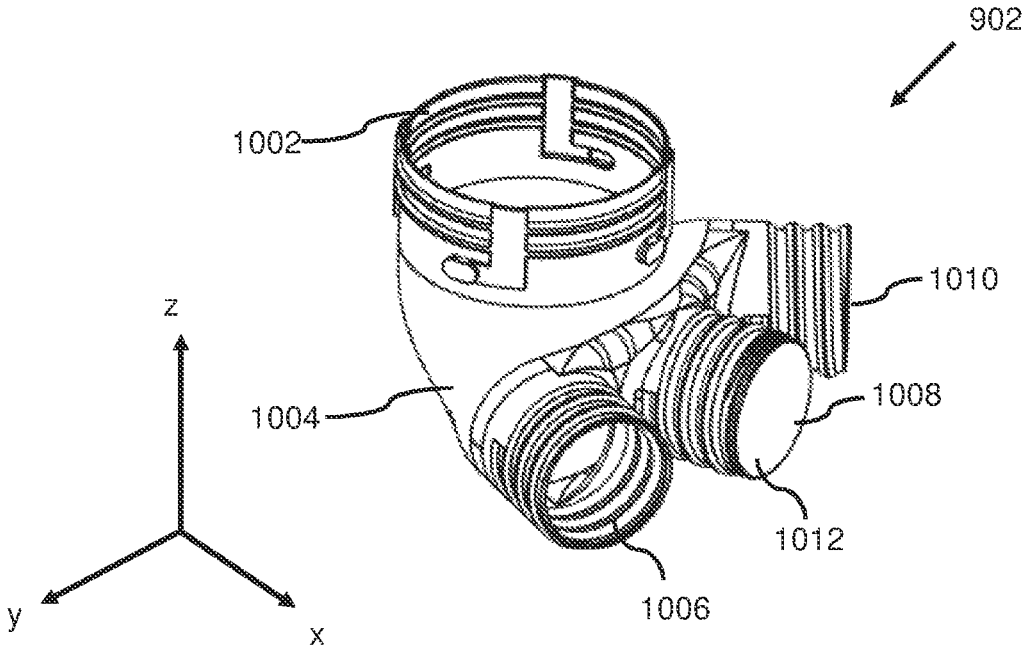
FIG. 10 illustrates a perspective view of the three outlet transition of the MDD of FIG. 9 in accordance with one or more embodiments of the present disclosure.

FIG. 10 illustrates a perspective view of the three outlet transition of the MOT 902 in accordance with one or more embodiments of the present disclosure.

The MOT 902 may include and input port 1002, a transition section 1004, an output port 1006, an output port 1008, and an output port 1010. As compared to the transition section 610 of the MOT 114 discussed above with reference to FIG. 6A-B, the transition section 1004 of the MOT 902 may be configured to provide a 90° change in the fluid path from the input port 1002 to the output ports 1006, 1008, and 1010. In this manner, in some instances, the input port 1002 may include a larger opening than each of the output ports

1006, 1008, and 1010. In some instances, the output ports 1006, 1008, and 1010 may be disposed in the same plane but directed in different directions. For example, while each of the output ports 1006, 1008, and 1010 may provide a 90° change with respect to the input port 1002 in an x-z plane, the output port 1008 may be generally in line with the input port 1002 in the x-y plane, while the output ports 1006 and 1010 may be at least slightly angled to their respective sides in the x-y plane.

In a manner similar to the MOT 114 discussed above with reference to FIG. 4, in one or more embodiments, at least one output port of the MOT 902 may include a cap that is configured to cover the at least one output port so as to close the at least one output port. The cap may be configured to be removed so as to open the at least one output port. For example, in the embodiment illustrated in FIG. 10, the output port 1008 has a cap 1012 disposed thereon. The cap 1012 may be disposed on any of the output ports. That is, any number of caps may be used herein. In some instances, the caps may be initially formed on the output ports and thereafter removed. In other instances, the caps may be removeably detached to the output ports before, during, or after manufacturing.

With a conventional downspout extension, water from the downspout may result in erosion at the area of the land surrounding the building. Such erosions may damage grass, create gullies, or generally decrease the look of the land. With a downspout extender and diverter in accordance with one or more embodiments of the present disclosure, the multi-directional diverter channels water away from the foundation of a building and in different directions. This reduces erosion in any one area of land surrounding the building. Further, pipe extensions may be attached to provide longer runs away from the building. Still further, threaded connections between components provide a water-tight fit between components.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A device for use with a rain downspout to output water, the device comprising:

an input port configured to receive the water from the rain downspout and having a tubular shape;

a first output port having a tubular shape defining a first central axis;

a second output port having a tubular shape defining a second central axis that is angled at a first acute angle relative to the first central axis;

a third outlet port having a tubular shape defining a third central axis that is angled at a second acute angle relative to the second central axis and at a third acute angle relative to the first central axis, wherein the second outlet port is disposed between the first outlet port and the third outlet port, and wherein the second acute angle is equal to the first acute angle;

a transition section extending between the input port and each of the first output port and the second output port and having a shape transitioning from the tubular shape of the input port to the tubular shapes of the first output port and the second output port; and a removable cap, wherein the first output port is configured to output a first portion of the received water in a first direction, wherein the second output port is configured to output a second portion of the received water in a second direction, wherein the third output port is configured to output a third portion of the received water in a third direction, and wherein the removable cap is configured to (i) cover the second output port to close the second output port and (ii) to be removed from the second output port to open the second output port.

2. The device of claim 1, wherein the removable cap is an integrated portion of the second output port and is configured to be cut away from the second output port.

3. The device of claim 1, wherein the removable cap includes a first circumferential thread, wherein the second output port includes a second circumferential thread corresponding to the first circumferential thread, and wherein the removable cap is detachably fastenable to the second output port by turning the cap such that the first circumferential thread engages the second circumferential thread.

4. The device of claim 1, wherein the first central axis, and the second central axis, and the third central axis are disposed in a common plane.

5. The device of claim 1, wherein the tubular shape of the input port defines a fourth central axis that is aligned with the second central axis.

6. The device of claim 1, wherein the tubular shape of the input port defines a fourth central axis that extends perpendicular to each of the first central axis, the second central axis, and the third central axis.

7. A downspout extension for use with a rain downspout, the rain downspout being configured to output water, the downspout extension comprising:

a downspout connector having a downspout connector input portion and a downspout connector output portion, the downspout connector input portion being configured to detachably fasten to the rain downspout to receive the water;

a removable cap;

an input flexible bellows having a first input flexible bellows end and a second input flexible bellows end, the first input flexible bellows end being configured to detachably fasten to the downspout connector output portion to receive the water; and a multi-directional downspout diverter comprising a diverter input port configured to detachably fasten to the second input flexible bellows end to receive the water and having a tubular shape, a first diverter output port having a tubular shape defining a first central axis, a second diverter output port having a tubular shape defining a second central axis that is angled relative to the first central axis, and a transition section extending between the diverter input port and each of the first diverter output port and the second diverter output port and having a shape transitioning from the tubular shape of the diverter input port to the tubular shapes of the first diverter output port and the second diverter output port, wherein the removable cap is configured to (i) cover the second diverter output port to close the second diverter output port and (ii) to be removed from the second diverter output port to open the second diverter output port.

8. The downspout extension of claim 7, wherein the removable cap is an integrated portion of the second diverter output port and is configured to be cut away from the second diverter output port.

9. The downspout extension of claim 7, wherein the removable cap includes a first circumferential thread, wherein the second diverter output port includes a second circumferential thread corresponding to the first circumferential thread, and wherein the removable cap is detachably fastenable to the second diverter output port by turning the cap such that the first circumferential thread engages the second circumferential thread.

10. The downspout extension of claim 7, further comprising an output flexible bellows having a first output flexible bellows end and a second output flexible bellows end, the first output flexible bellows end being configured to detachably fasten to the first diverter output port.

11. The downspout extension of claim 10, wherein the downspout connector, the input flexible bellows, the multi-directional downspout diverter, and the output flexible bellows comprise the same material.

12. The downspout extension of claim 7, further comprising:

a third diverter output port, wherein the third diverter output port is configured to output a third portion of the received water in a third direction.

13. The downspout extension of claim 7, wherein the downspout connector input portion includes a first connector input portion and a second connector input portion, wherein the second connector input portion is detachably fastened to the first connector input portion, wherein the first connector input portion has a first opening having a first cross-sectional area, and wherein the second connector input portion has a second opening having a second cross-sectional area that is smaller than the first cross-sectional area.

14. The downspout extension of claim 7, wherein the downspout connector input portion has a rectangular cross-section.

15. The downspout extension of claim 7, wherein the downspout connector input portion has a round cross-section.

16. The downspout extension of claim 7, wherein the first central axis and the second central axis define an acute angle therebetween.

17. The downspout extension of claim 7, wherein the first central axis and the second central axis are disposed in a common plane.

18. The downspout extension of claim 7, wherein the tubular shape of the input port defines a third central axis that is aligned with the first central axis or the second central axis.

* * * * *